United States Patent [19]

Haas

[11] 4,279,453

[45] Jul. 21, 1981

[54] COMBINED CHEST OF DRAWERS AND SEWING MACHINE TABLE

[75] Inventor: Robert V. Haas, Edison, N.J.

[73] Assignee: The Singer Company, Stamford, Conn.

[21] Appl. No.: 132,938

[22] Filed: Mar. 24, 1980

[51] Int. Cl.[3] ..... A47B 77/10; A47B 29/00

[52] U.S. Cl. ..... 312/282; 312/314; 312/317 R; 312/23; 312/27; 112/217.1

[58] Field of Search ..... 312/282, 266, 316, 315, 312/314, 317 R, 317 A, 27, 23, 29; 112/217.1

[56] References Cited

U.S. PATENT DOCUMENTS

| | | | |
|---|---|---|---|
| D. 148,949 | 3/1948 | Peets | 15/69 |
| D. 175,515 | 9/1955 | Lerch | 312/317 R |
| 219,263 | 9/1879 | Hosford | 312/30 |
| 290,168 | 12/1883 | Basford | 312/266 |
| 531,003 | 12/1894 | O'Keeffe | 312/317 R |
| 621,889 | 3/1899 | Yunck | 312/266 |
| 806,277 | 12/1905 | McKee | 312/266 |
| 1,080,019 | 12/1913 | Pooler et al. | 312/27 |
| 1,160,126 | 11/1915 | Baron | 312/282 |
| 2,124,972 | 7/1938 | Engel | 312/27 |
| 2,532,041 | 11/1950 | Thompson | 312/317 R |
| 2,565,456 | 8/1951 | Peets | 312/282 |
| 2,585,566 | 2/1952 | Lundstrom | 312/27 |
| 2,643,167 | 6/1953 | Wade | 312/27 |
| 2,741,522 | 4/1956 | Lerch | 312/29 |
| 2,988,413 | 6/1961 | Bergen | 312/282 |
| 3,306,690 | 2/1967 | Gibson et al. | 312/314 |
| 3,395,959 | 8/1968 | White | 312/282 |
| 3,636,548 | 1/1972 | Maruzzelli | 312/282 |
| 3,726,237 | 4/1973 | Devey et al. | 112/217.1 |
| 3,946,682 | 3/1976 | Cowdrey et al. | 112/217.1 |
| 4,123,124 | 10/1978 | Peets | 112/217.1 |

*Primary Examiner*—Victor N. Sakran
*Attorney, Agent, or Firm*—William V. Ebs; Robert E. Smith; Edward L. Bell

[57] ABSTRACT

A sewing machine supporting work table including a pair of front legs is connected to a chest of drawers by parallel links on which the table is movable between alternate positions in an arc carrying the legs over an underlying surface. In one position of the table, the top of the table is a top for the chest of drawers and the legs blend into the chest, whereas in the other position of the table the top projects frontally therefrom providing space for the knees of an operator and the legs are separated from the chest.

8 Claims, 9 Drawing Figures

COMBINED CHEST OF DRAWERS AND SEWING MACHINE TABLE

DESCRIPTION

BACKGROUND OF THE INVENTION

1. Field of the Invention

The invention relates to cabinets of a kind wherein a sewing machine may be disposed in a stowed position and which are constructed to support the machine in a use position.

2. Description of the Prior Art

It is well known to provide a cabinet with space for stowing a sewing machine, and with means for moving the machine to one side of the cabinet where an operator may sit with knees beneath the machine. However, it has been a disadvantage of such sewing cabinets that a substantial amount of wall space has been required to accommodate the sewing machine in its use position.

Sewing cabinets have also been characterized by other disadvantages such as the lack of a stable support for the machine when in a use position, the necessity of dragging a support for the machine across the nap of a carpet, and the inclusion of mechanism which is unsuited from the standpoint of cost and durability, for use in guiding the machine to a position where it can be used conveniently by an operator.

SUMMARY OF THE INVENTION

In accordance with the invention, a sewing machine and work supporting table including a pair of front legs is connected by parallel links to a chest of drawers. The table is movable on the parallel links between alternate positions in one of which the top of the table is a top for the chest of drawers and the legs blend into the chest, but in the other of which the top of the table projects frontally from the chest into a room providing space for the legs of an operator and the legs of the table are separated from the chest. The table is moved in an arc on the parallel links between its alternate positions and the legs are raised preventing any damage to the underlying surface such as the nap of a rug. The sewing machine is mounted on a rear portion of the table for movement between a stowed position below the top surface of the table and a flat bed position. A front portion of the table can be moved relative to the rear portion to provide for free arm sewing.

DESCRIPTION OF THE PREFERRED EMBODIMENT OF THE INVENTION

Figure 1:
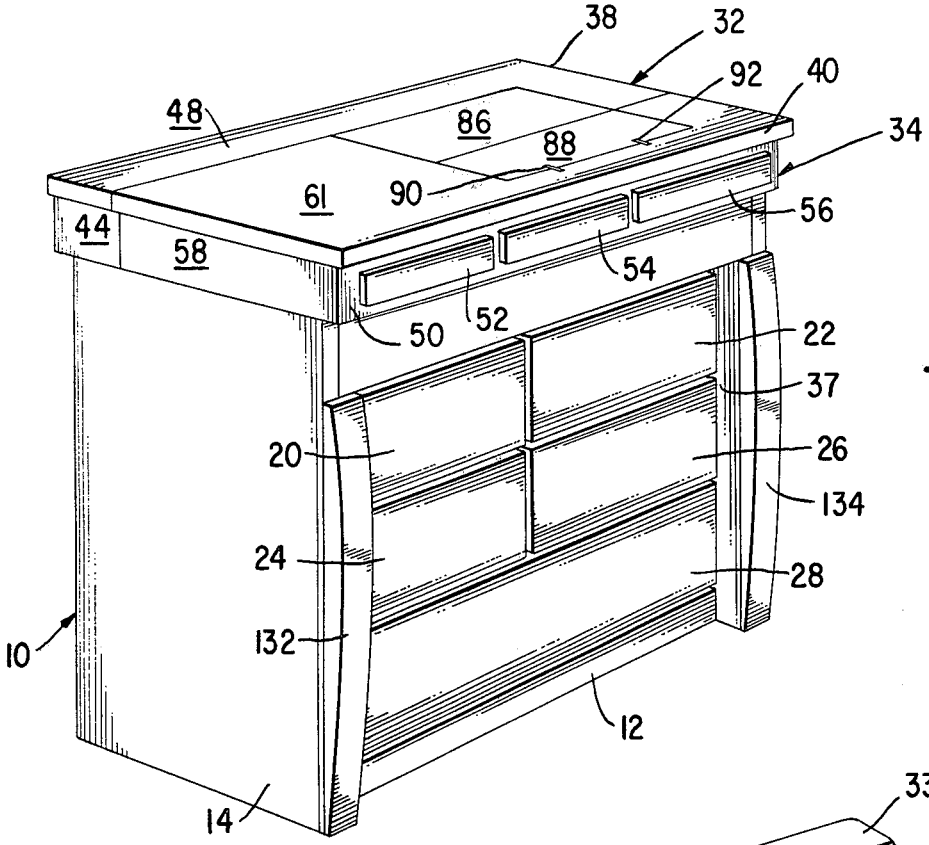
FIG. 1 is a front perspective view showing a combined chest of drawers and sewing machine table according to the invention.
Figure 2:
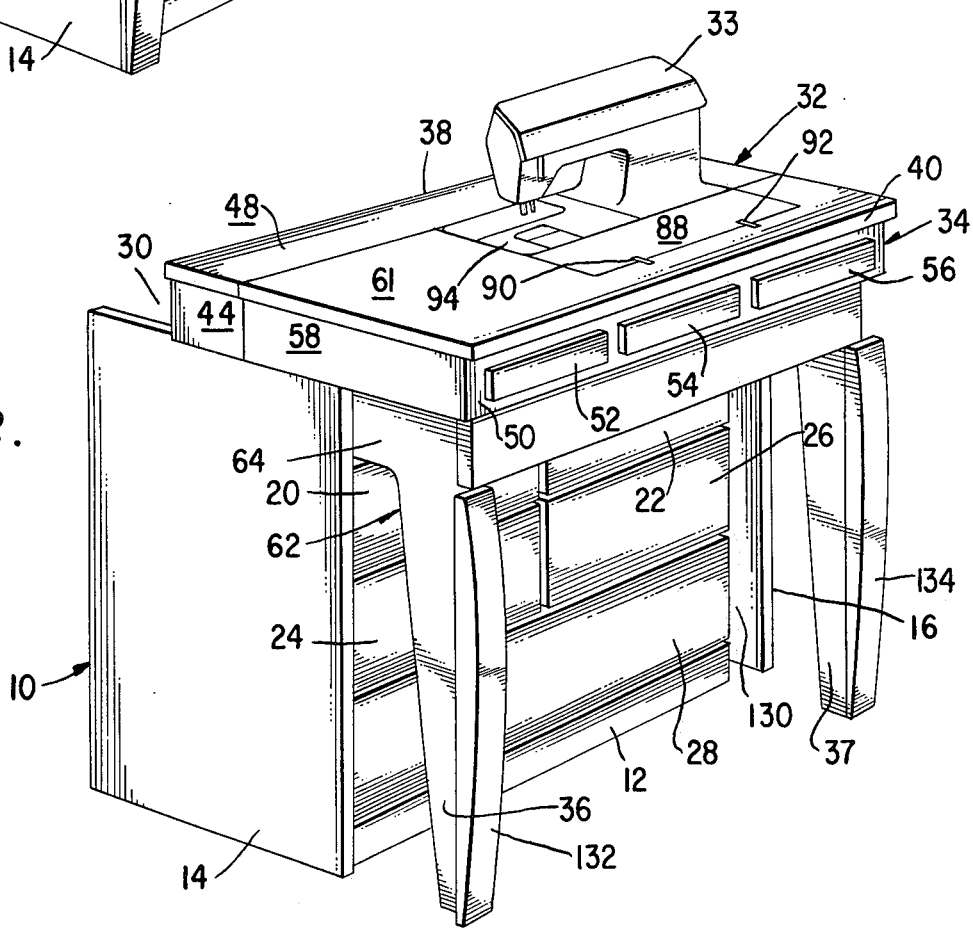
FIG. 2 is a view similar to FIG. 1 showing the table in a frontal position relative to the chest of drawers.
Figure 3:
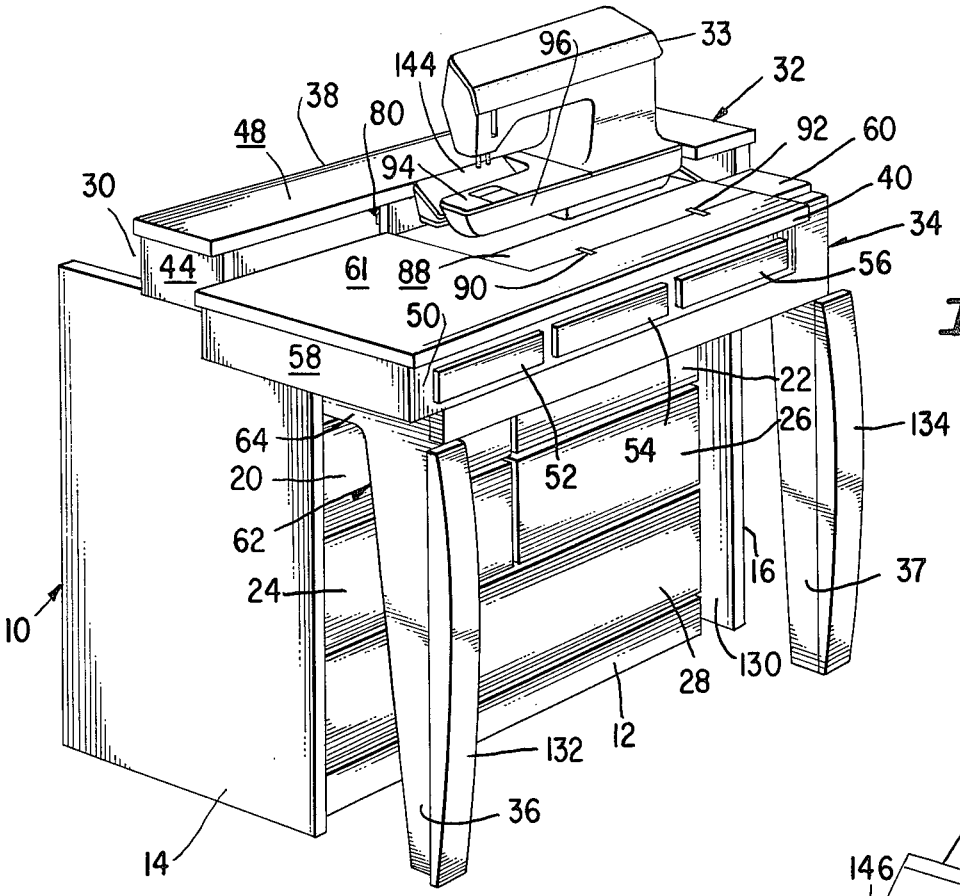
FIG. 3 is a view similar to FIG. 2 showing a portion of the table disposed to provide for free arm sewing.

Referring to the drawings, and in particular to FIGS. 1, 2 and 3, reference character 10 designates a chest of drawers including a base 12, side panels 14 and 16, a back panel 18, slidable drawers 20, 22, 24, 26 and 28, and a void 30 extending over the drawers and between the side panels. Reference character 32 designates a table which is adapted to support a sewing machine 33 in a stowed or use position. A parallel linkage arrangement which is described hereinafter connects the table to the chest of drawers in a manner permitting the table to move between a position complimentary to the chest wherein an upper portion 34 of the table provides a top for the chest of drawers and legs 36 and 37 of the table are nested in the chest as shown in FIG. 1, and a position wherein a part of the table projects frontally from the chest and the legs are separated therefrom as shown in FIG. 2. The table includes a rear portion 38, and includes a front portion 40 which can be lowered relative to the rear portion (FIG. 3) to permit free arm sewing operations to be performed at the table.

Rear portion 38 of the table is formed with a back panel 42, side trim pieces 44 and 46 which are glued or otherwise suitably secured to the back panel, and a top panel 48 which is secured to the back panel and trim pieces. Front portion 40 is formed with a front piece 50 that includes false drawers 52, 54 and 56, with side trim pieces 58 and 60 that are affixed to the front piece 50, and with a top panel 61 that is affixed to front piece 50 and the side trim pieces 58 and 60.

The table is provided with supporting structure 62 for the rear and front portions 38 and 40 respectively of the table. Such supporting structure includes side pieces 64 and 66, leg 36 which depends from side piece 64, and leg 37 which depends from side piece 66. The rear portion 38 of the table is affixed as with adhesive to top edges of the side pieces 64 and 66. Front portion 40 of the table, however, is hingedly connected to supporting structure 62 as at 68 and 70 in the manner disclosed in U.S. Pat. No. 3,946,682, and can be moved between a raised latched position wherein the top panel 61 is level with the top panel 48 of the rear portion 38, and a lowered position wherein the top panel 61 is below the level of panel 48.

Figure 4:
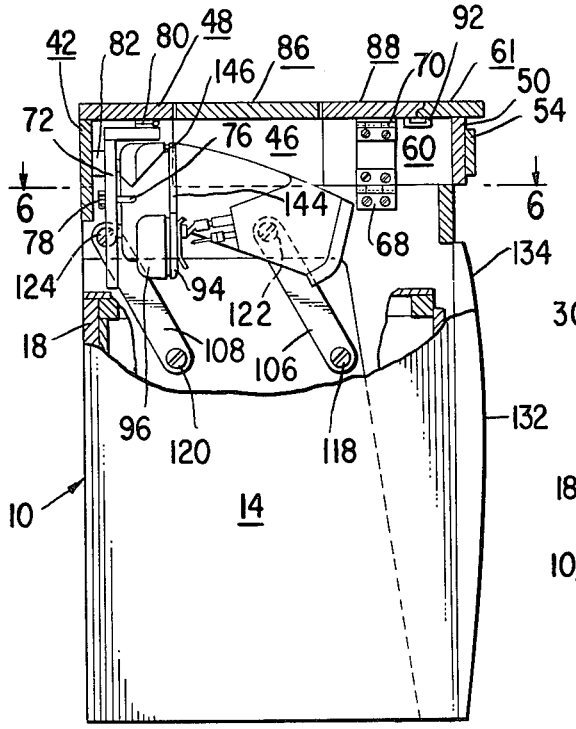
FIG. 4 is a side elevational view partially in section, showing the table in a rearward position.
Figure 5:
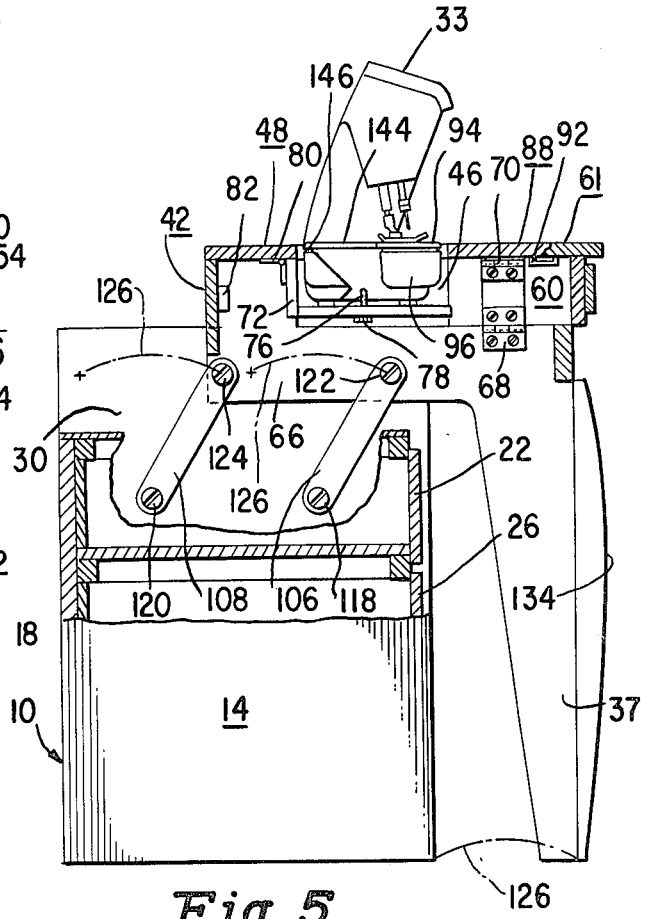
FIG. 5 is a side elevational view partially in section showing the table in a frontal position.
Figure 6:
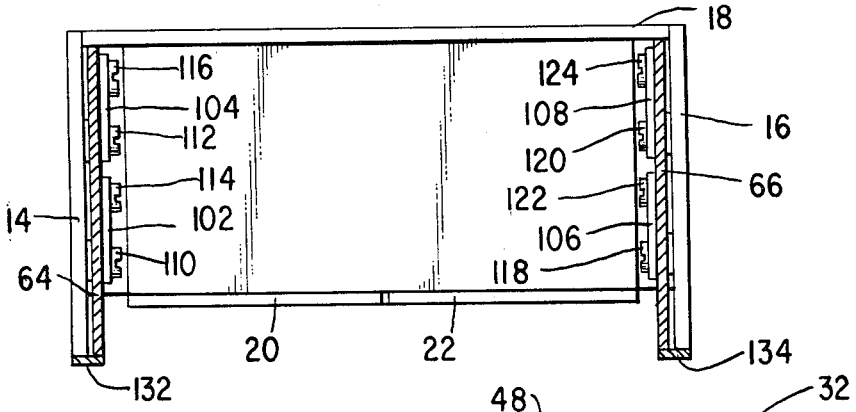
FIG. 6 is a top plan view taken on the plane of the line 6—6 of FIG. 4.
Figure 7:
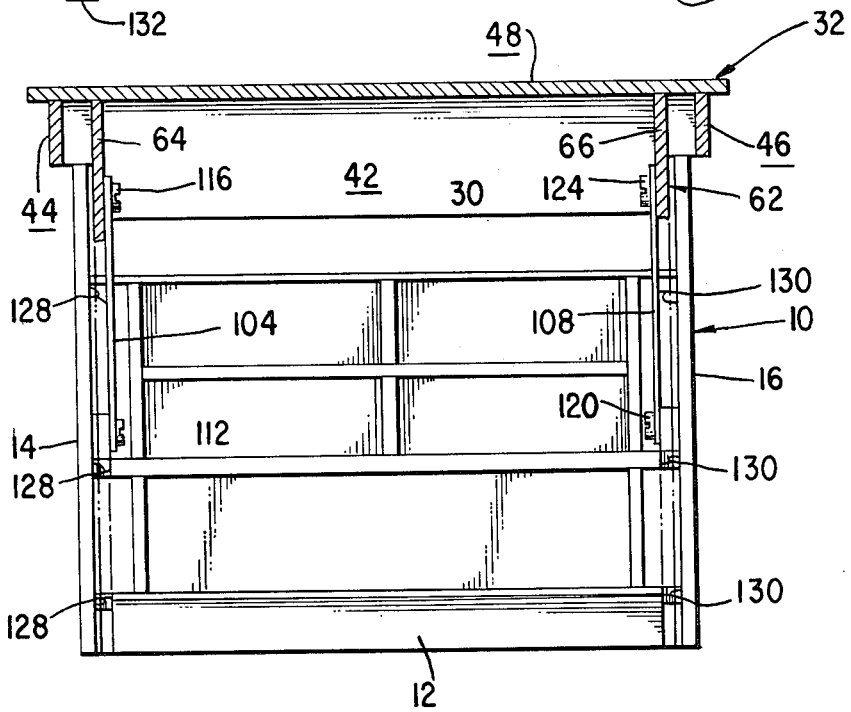
FIG. 7 is a front view, partially in section, showing the chest with drawers removed and the sewing machine table with the legs in phantom.
Figure 8:
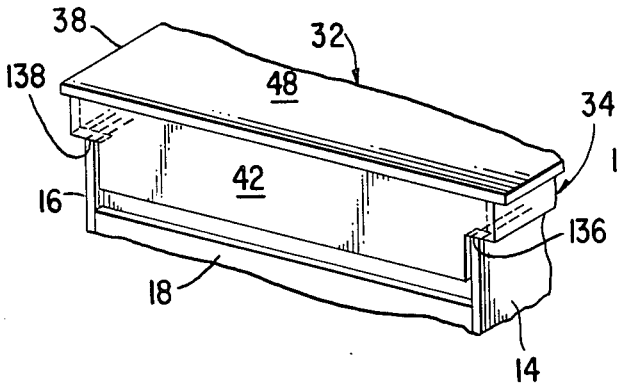
FIG. 8 is a fragmentary rear perspective view showing the sewing machine table in a rearward position on the chest of drawers; and, FIG. 9 is a view similar to FIG. 6 showing the table in a frontal position.
Figure 9:
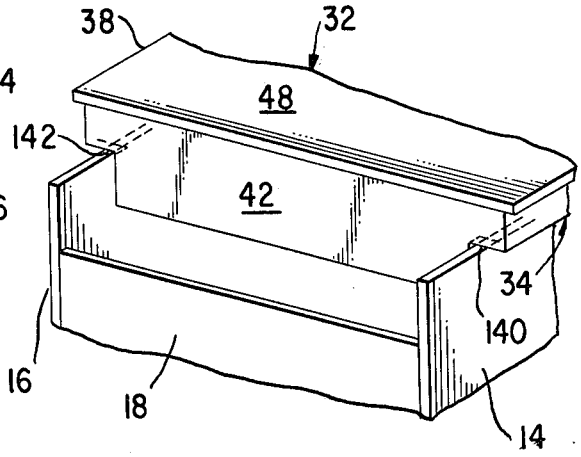

The table includes a platform 72 to which sewing machine 33 is shown secured by a mounting hook 76 and nut 78. Such platform is mounted by means of a hinge 80 on the underside of top panel 48 and can be moved between a lowered position as shown in FIG. 4 wherein the underside of the platform engages a stop 82 on back panel 42, and a raised position as shown in FIG. 5 wherein it may be retained by a latch (not shown). In the lowered position of platform 72, the sewing machine 33 is disposed in a stowed position below the top panels 48 and 61. The machine in such stowed position extends beneath a removable portion 86 and hinged portion 88 respectively of the top panel 61. When the platform is to be raised, panel portion 86 is removed from the table and portion 88 is folded back on its hinges 90 and 92 to provide clearance for the machine 33. In the raised position of platform 72, a top work supporting surface 94 of the bed 96 of the machine is level with the top panel 48 of the rear portion 38 of the table.

As noted hereinbefore, a parallel linkage arrangement connects table 32 to the chest of drawers 10 and enables the table to be moved outwardly from the chest of drawers into a room. Such linkage arrangement includes one pair of parallel links 102 and 104 and a corresponding pair of links 106 and 108. Links 102 and 104 are pivotally connected at their lower ends by shoulder screws 110 and 112 respectively, to side panel 14 of the chest of drawers 10, and are pivotally connected at upper ends by shoulder screws 114 and 116 respectively to side piece 64 of the supporting structure 62 of the table. Links 106 and 108 pivotally connect at lower ends with screws 118 and 120 respectively to side panel 16 of the chest of drawers, and pivotally connect at upper ends with screws 122 and 124 respectively to side piece 66 of supporting structure 62 of the table.

The table 32 moves in an arc 126 on the links 102, 104, 106 and 108 between the position wherein the upper portion of the table is a top for the chest of drawers and a position wherein part of the table projects forwardly from the chest. There is therefor no dragging of the legs 36 and 37 across an underlying surface as the table is moved away from or toward the chest. As may be seen in FIG. 1, when the table is in the rearward position it compliments the chest of drawers. The legs 36 and 37 then nest in accommodating spaces 128 and 130 respectively in the chest of drawers and ornamental appendages 132 and 134 on the legs engage front edges of the side panels 14 and 16 of the chest. In the rearward position of the table, top portion 34 of the table is supported by its legs 36 and 37 and on top edges of side panels 14 and 16 of the chest of drawers at 136 and 138. In the forward position of the table it is supported on the legs 36 and 37 and the top edges of the side panels 14 and 16 at 140 and 142.

In normal use of the combined chest of drawers 10 and table 32 as a piece of furniture the chest of drawers is against a wall, the table 32 is in its rearward position complimentary to the chest and the sewing machine 33 is in its stowed position. When sewing is to be performed, the table is moved on links 102, 104, 106 and 108 to its frontal position, and the sewing machine is raised with platform 72 by pulling up on the machine. Flat bed sewing is performed with panels 48 and 61 at the same level which is the level of the working surface 94 of the bed 96 of the sewing machine when raised. If free arm sewing is to be performed, the front portion 40 of the table is pivoted to its lowered position wherein it is disposed below the level of the sewing machine bed 96, and a rear portion 144 of the bed is moved about a hinge 146 into a position away from work supporting surface 94.

It should be understood that the present disclosure relates to only a preferred structural arrangement of the invention and should not be construed as a limitation thereof. Numerous alterations and modifications of the structure herein disclosed will suggest themselves to those skilled in the art, and all such modifications which do not depart from the spirit and scope of the invention are intended to be included within the scope of the appended claims.

I claim:

1. In combination, a chest of drawers, a sewing machine supporting work table including a pair of front legs, and parallel links which connect the table to the chest of drawers and on which the table is movable between alternate positions of engagement with table supporting portions of the chest of drawers in an arc carrying the legs over an underlying surface, the table in one of the alternate positions being disposed with the top thereof extending over and providing a top for the chest of drawers, the table in the other of the alternate positions being disposed with the top projecting frontally therefrom a substantial distance and the legs separated from the chest with room under the table in front of the chest of drawers between the legs of the table for the legs of a sewing machine operator.

2. The combination of claim 1 wherein the legs nest in the chest of drawers in the said one position of the table.

3. The combination of claim 1 wherein the table includes a platform to which the sewing machine attaches and with which the machine is movable to a stowed position beneath the top surface of the table when the table is in the said one position, the chest of drawers including a void over drawers to accommodate the sewing machine in the stowed position.

4. The combination of claim 1 wherein the table includes one portion which is adapted to support the sewing machine, and another portion which is movable between a position level with said one portion providing for flat bed sewing and a lowered position for free arm sewing.

5. The combination of claim 4 wherein the movable portion of the table is at the front thereof.

6. The combination of claim 4 wherein the table includes side members from which the legs depend and to which said one portion of the table is permanently affixed, the other portion of the table being mounted thereon for movement between the position providing for flat bed sewing and the position for free arm sewing.

7. The combination of claim 6 wherein the said one and another portion of the table are supported by the chest of drawers and said legs in each of the alternate positions of the table.

8. The combination of claim 7 wherein the machine supporting portion of the table and movable portion thereof include work supporting surfaces at the rear and front respectively of the table.

* * * * *